United States Patent [19]

Crawford

[11] Patent Number: 5,037,158

[45] Date of Patent: Aug. 6, 1991

[54] HEIGHT ADJUSTMENT MECHANISM FOR CHAIR BACK

[75] Inventor: Jeff Crawford, Allentown, Pa.

[73] Assignee: Westinghouse Electric Corporation, Pittsburgh, Pa.

[21] Appl. No.: 465,340

[22] Filed: Jan. 16, 1990

[51] Int. Cl.[5] ..... A47C 7/46

[52] U.S. Cl. ..... 297/353; 248/408; 248/297.3; 403/107

[58] Field of Search ..... 297/353, 410; 248/244, 248/297.3, 407, 408; 403/105-108

[56] References Cited

U.S. PATENT DOCUMENTS

| | | | |
|---|---|---|---|
| 979,149 | 12/1910 | Gay . | |
| 1,210,199 | 12/1916 | Passeck . | |
| 1,400,960 | 12/1921 | Lambert . | |
| 1,569,708 | 1/1926 | Burns et al. . | |
| 2,256,856 | 9/1941 | Zwald . | |
| 3,162,416 | 12/1964 | Amarillas . | |
| 3,792,898 | 2/1974 | Lindbert . | |
| 3,854,772 | 12/1974 | Abrahamson et al. . | |
| 4,012,158 | 3/1977 | Harper . | |
| 4,043,592 | 8/1977 | Fries . | |
| 4,221,430 | 9/1980 | Frobose | 297/353 |
| 4,384,742 | 5/1983 | Wisniewski . | |
| 4,451,084 | 5/1984 | Seeley | 297/453 |
| 4,596,421 | 6/1986 | Schmitz . | |
| 4,639,039 | 1/1987 | Donovan . | |
| 4,660,885 | 4/1987 | Suhr et al. . | |
| 4,749,230 | 6/1988 | Tornero . | |

FOREIGN PATENT DOCUMENTS 636573 5/1950 United Kingdom .

*Primary Examiner*—Peter R. Brown

*Attorney, Agent, or Firm*—Mason, Fenwick & Lawrence

[57] ABSTRACT

A height adjustment mechanism for controlling the height of a chair back relative to a chair seat. A vertical member contains a centrally located camming slot that is elongated in a vertical direction and has a series of notches located along one side and a smooth surface located along the other side. The top and bottom of the camming slot contain downwardly directed camming surfaces. The back adjustment plate includes a centrally located horizontal slot. A guide pin is positioned within the slot and is supported by an S-shaped leaf spring. When the guide pin is moved in either direction away from the central axis of the slot, the spring causes the pin to be biased in the direction that the pin has been moved away from. In order to raise the chair back relative to the seat, the chair back is grasped by the user and pulled in an upward direction whereupon the pin is urged in the direction of the notches and registers in each of the notches as the chair back is moved in an upward direction. In order to lower the seat back, the seat back is raised fully which causes the pin to be urged in the direction of the smooth surface. As the pin rides along the upper surface in the direction of the smooth surface, the pin will pass the halfway point in the slot and spring will urge the pin in the direction of the surface.

38 Claims, 3 Drawing Sheets

HEIGHT ADJUSTMENT MECHANISM FOR CHAIR BACK

BACKGROUND OF THE INVENTION

1. Field Of Use

The present invention relates to a mechanism for controlling the relative space created between two components, in general, and to a height adjustment mechanism for controlling the height of a chair back and the relative spacing between a chair seat and the chair back, in particular.

2. Brief Description Of The Prior Art

Prior art chair back height adjustment mechanisms are available in various forms. In some, a manually operable screw releasably secures a slidably adjustable back at desired positions on an upwardly extending J-bar which is part of a chair frame. In others, a manually operable rack-and-pinion-type or ratchet-type mechanism enables chair back height adjustment. Such prior mechanisms are typically relatively complex in constructions, costly to manufacture, trouble-prone and unreliable in use.

U.S. Pat. No. 4,102,549 (Morrison et al) assigned to Knoll International, Inc., relates to an adjustable back support using a position stop of flexible material which may be flexed from an engaged position in which the back support of the chair is locked by the position stop to a disengaged position in which the back stop is movable.

U.S. Pat. No. 4,639,039 (Donovan) relates to a height adjustment mechanism for a chair back. The Donovan patent discloses an adjustment mechanism for manually positioning and releasably locking a chair back in a desired vertical position relative to a chair seat. The mechanism is made up of a guide rigidly secured to an upright back support frame of a chair and a channel rigidly secured to the back. The channel is mounted for vertical sliding movement on the guide. The channel includes a slot having a plurality of vertically arranged notches along one vertical edge of the slot, and three other cam surfaces to complete a closed geometric figure.

A latch bar is pivotally mounted on a pivot pin on the guide and has a latch pin extending into the slot. A torsion spring mounted on the guide between the guide and channel biases the latch bar in a latched position, wherein the latch pin releasably engages a notch to maintain the back at a selected height. Manually raising the back slightly above the highest latched position causes the latch pin to pivot the latch bar to a spring biased unlatched position. Then, manually lowering the back to its lowest position causes the latch bar to pivot into an unlatched position, where the latch pin engages the highest notch to maintain the back in its lowest position.

U.S Pat. No. 4,749,230 (Tornero) relates to a height adjusting device for manually locating and automatically locking a chair back at a desired vertical position relative to a chair seat. The device generally comprises two guided and slidably interlocking plates and one lock pin. The lock pin is free to move within a sinus-shaped slot defined within one plate and forced therewith from one locked position to a stand-by position, or to an unlocked position by the cam action of any of a plurality of notches and inclined surfaces of a slotted cam contained on the other plate. According to the Tornero patent, the device is characterized by the absence of springs or other supplementary biasing means.

There is thus a need for height adjustment mechanism for adjusting the relative distance between a chair seat and a chair back where the mechanism is simple, easy to use and, at the same time, highly reliable. The present invention is directed toward filling that need.

SUMMARY OF THE PRESENT INVENTION

The present invention relates to a height adjustment mechanism for controlling the height of a chair back relative to a chair seat. A chair embodying the teachings of the present invention includes a pedestal base supported by casters. Mounted on the base is a conventional pneumatic height adjustment mechanism. Secured to the height adjustment mechanism is a housing that includes a chair tilting mechanism for tilting the seat and back of the chair. The chair back is supported by a back support link mounted to the housing. Of particular interest to the present invention is the structure associated with mounting the chair back to the link. This structure includes the means by which the height and positioning of the chair back relative to the seat is accomplished.

The height adjustment mechanism includes a generally L-shaped back adjustment member that includes a horizontal welded structure and a vertically disposed rectangular-shaped planar structure. In a preferred embodiment, side edges of the horizontal portion are received within slots defined in opposed legs of the back support link.

The vertical member contains a centrally located camming slot that is elongated in a vertical direction and has a series of notches located along one side and a smooth surface located along the other side. The top of the camming slot contains a downwardly directed camming surface which moves downwardly from the smooth surface to the uppermost of the several notches. The bottom of the camming slot contains a lower camming surface which moves in a generally downward direction from the side surface to the lowermost notch.

The chair back generally consists of a structural shell. A cushion is secured to the front surface of the structural shell and then is covered with a suitable fabric. Defined along the lower central portion of the chair back indented from the back surface is a recessed area. A generally planar back adjustment plate is secured to the recessed area and provides a mounting channel for receiving the vertical portion of the support bar.

The back adjustment plate contains a centrally located slot that is generally elongated in a substantially horizontal direction. A guide pin is positioned within the slot and is supported by an S-shaped leaf spring. The leaf spring is configured in such a way that when the guide pin is moved in either direction away from the central axis of the slot, the spring causes the pin to be biased in the direction that the pin has been moved away from.

In order to raise the chair back relative to the seat, the chair back is grasped by the user and pulled in an upward direction. The user will then be able to perceive the movement of the pin as it is urged in the direction of the notches and registers in each of the notches as the chair back is moved in an upward direction.

In order to lower the seat back, the seat back is raised fully which causes the pin to be urged in the direction of the smooth surface. As the pin rides along the upper surface in the direction of the smooth surface, the pin will pass the halfway point in the slot and spring will urge the pin in the direction of the surface. This then allows the seat back to be moved in a downward direction as the pin travels along the surface until the pin reaches the bottom surface. At this point, the pin will be guided in a direction toward the notches. Thus, when the pin moves past the central axis along the slot, the pin will be urged in a direction of the notch by the spring. At this point, the height adjustment cycle may be repeated.

Thus, it is a primary object of the present invention to provide an easily manipulated and simple to operate mechanism for adjusting the height of the back of a chair.

It is another object of the present invention to provide a mechanism for adjusting the height of the back of the chair which is simple and inexpensive to fabricate and install.

These and other objects will become apparent when reference is made to the following detailed description.

DETAILED DESCRIPTION OF THE PREFERRED EMBODIMENTS

Figure 1:
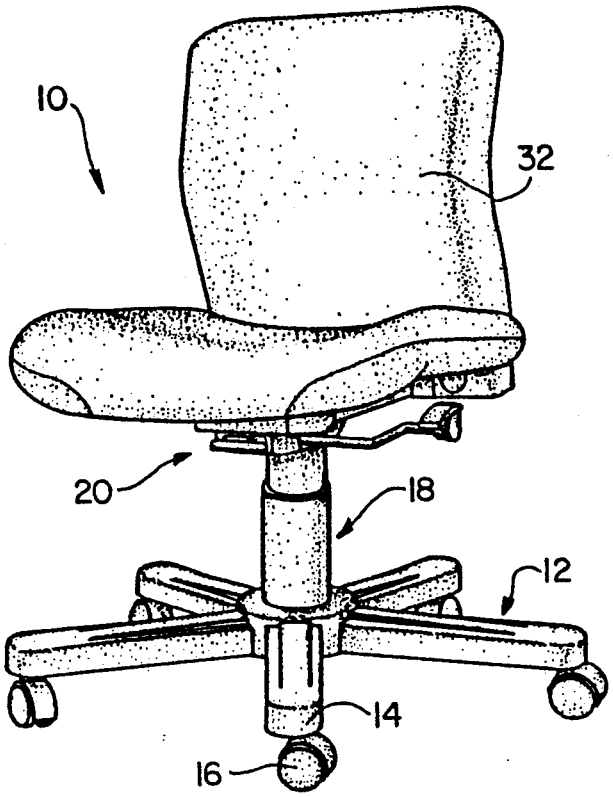
FIG. 1 is a perspective view of a chair incorporating the inventive height adjustment mechanism.
Figure 2:
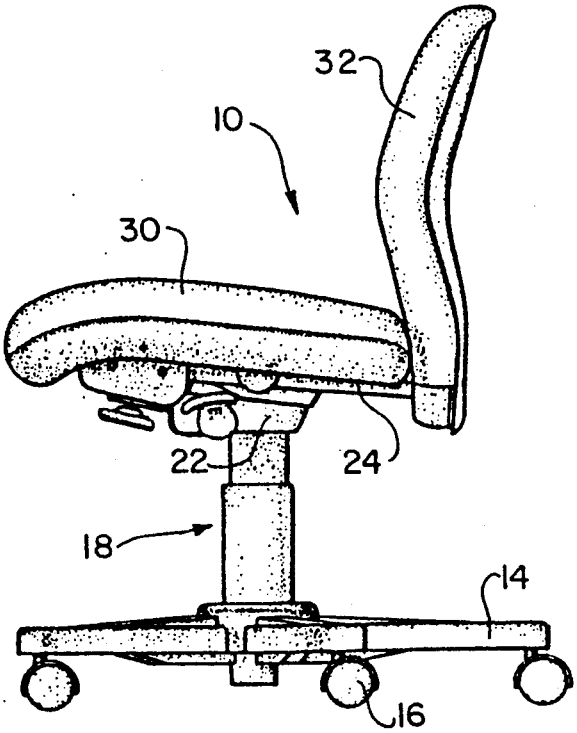
FIG. 2 is a side view of the chair of FIG. 1.

In describing the preferred embodiments of the subject invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

FIG. 1 shows a chair 10 incorporating the teachings of the present invention. The chair generally comprises a conventional five-star pedestal base 12 where each of the legs 14 of the base is supported by a caster 16 to facilitate movement of the chair along a surface. Mounted on the base is a conventional pneumatic height adjustment mechanism 18. Secured to the height adjustment mechanism is a chair tilting mechanism 20. In a preferred embodiment, the chair tilting mechanism 20 is of the type discussed in co-pending U.S. patent application Ser. No. (465,342, entitled CHAIR TILT AND CHAIR HEIGHT APPARATUS, filed on even date herewith, assigned to Knoll International, Inc., the same company as the present application, and incorporated by reference herein. As it relates to the present invention, the tilt mechanism essentially comprises three parts. A housing 22 is mounted to the height adjustment mechanism 18. A chair back support link 24 is pivotally mounted to the housing. The link includes a pair of spaced L-shaped legs 151 and 152 joined at the back end by a cross member 154 that is welded to the legs. A seat support mounting plate 26 is pivotally mounted to the housing and has secured to it a chair seat structure 30.

As will be described in greater detail hereinafter, the chair back support link 24 supports a chair back 32. Of particular interest to the present invention is the structure associated with mounting the chair back 32 to the link 24. This structure includes the means by which the height and positioning of the chair back 32 relative to the seat 30 is accomplished.

Figure 3:
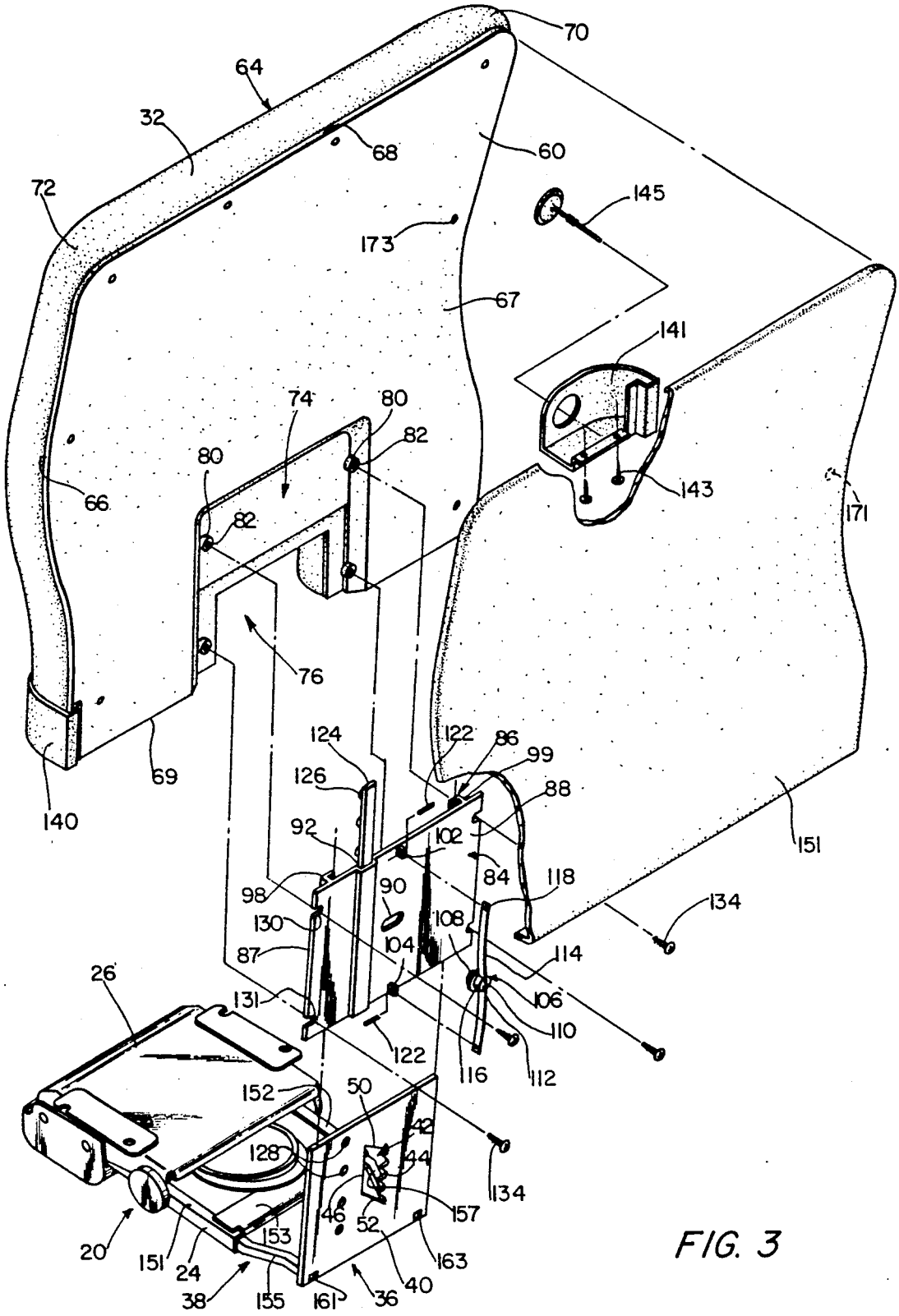
FIG. 3 is an exploded view of the height adjustment mechanism found in the chair of FIG. 1.
Figure 4:
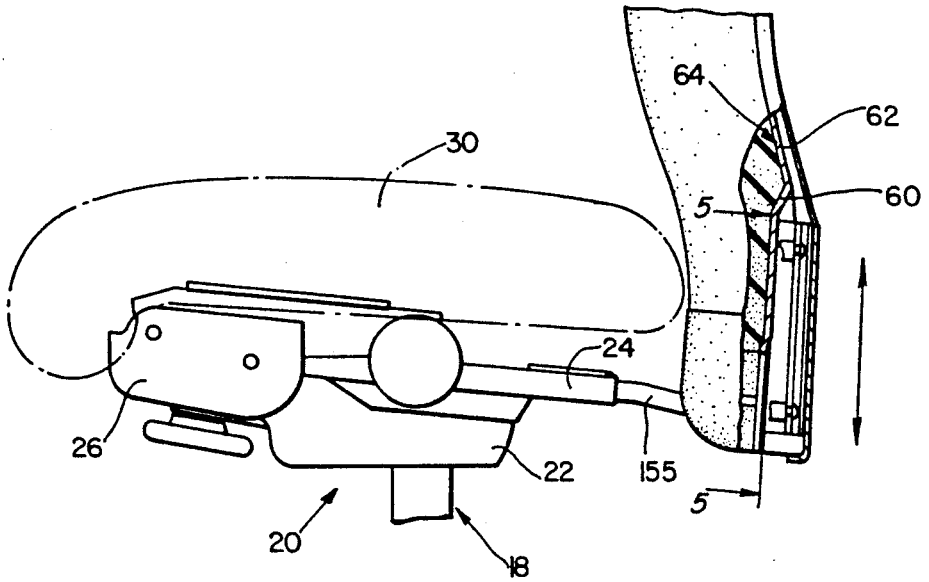
FIG. 4 is a schematic side view partially cut-away of the height control mechanism of FIG. 3.

As oriented in FIG. 3, a back adjustment bar 36 consists of a generally L-shaped member that includes a horizontal welded structure 38 and a vertically disposed rectangular-shaped planar structure 40. In a preferred embodiment, the welded structure includes a pair of spaced bent legs 155 and 157. As shown in FIGS. 3 and 4, solid legs 155 and 157 bend inwardly and downwardly as they move from the link 24 to their point of attachment a the bottom of planar structure 40. The tips of legs 155 and 157 are welded in cutouts 161 and 163 defined in structure 40. Side edges of the horizontal legs 155 and 157 are received within slots defined in opposed legs 151 and 152, respectively, of the back support link 24. The horizontal member being preferably made of steel is secured within the slots by welding.

The vertical member 40 contains a centrally located camming slot 42 in the form of a closed geometric pattern. As oriented in FIG. 5, the slot is elongated in a vertical direction and has a series of notches 44 located along one side and a smooth surface 46 located along the other side. The top of the camming slot contains a downwardly directed camming surface which moves downwardly from the smooth surface to the uppermost of the several notches 44. In a preferred embodiment, the camming surface 50 is at an angle of about 30° relative to a horizontal axis H. The bottom of the camming slot contains a lower camming surface 52 which moves in a generally downward direction from the side surface 46 to the lowermost notch 44. In a preferred embodiment, the lower camming surface 52 is at an angle of about 45° relative to horizontal axis H. All of the camming surfaces 44, 46, 50 and 52 together define the closed geometric pattern.

Chair back 32 generally consists of a structural shell 60. As oriented in FIG. 3, the structural shell 60 consists of a smooth back surface 62, a smooth front surface 64, side edges 66 and 67, a top edge 68 and a bottom edge 69. A cushion 70 is positioned against the front surface 64 of the structural shell. The cushion, which in a preferred embodiment is made of conventional foam rubber, is then covered with a suitable fabric 72 for finishing an decorative purposes. The fabric holds the cushion in place against the structural shell. The bottom of the chair back is complemented with a pair of upholstery cups 140 and 141 that are placed over fabric 72 at each of the lower corners of the chair back. Each of the cups is held in place and secured to the structural shell by suitable fasteners, such as screws 143, and a button pin 145.

A cosmetic shell 151 is secured to the back of the structural shell 60 through a series of peripherally-spaced fasteners 171 that mate with a complementary series of peripherally-spaced holes 173 defined in the structural shell. In a preferred embodiment, the fasteners 171 are conventional "Christmas tree" fasteners made of plastic.

Defined along the lower central portion of the chair back 32 indented from the back surface 62 is a recessed area 74. The recessed area includes a lower rectangular-shaped cutout 76 that facilitates mounting of the chair back relative to the back link 24. The recessed area is generally rectangular-shaped and has a series of bosses 80 located near the corners defined by the rectangular recess. Each boss has a bore 82 for receiving a fastening device, such as a screw 134. A generally planar back adjustment plate 84 provides a mounting channel 86 for receiving the vertical portion of the support bar 40.

Figure 5:
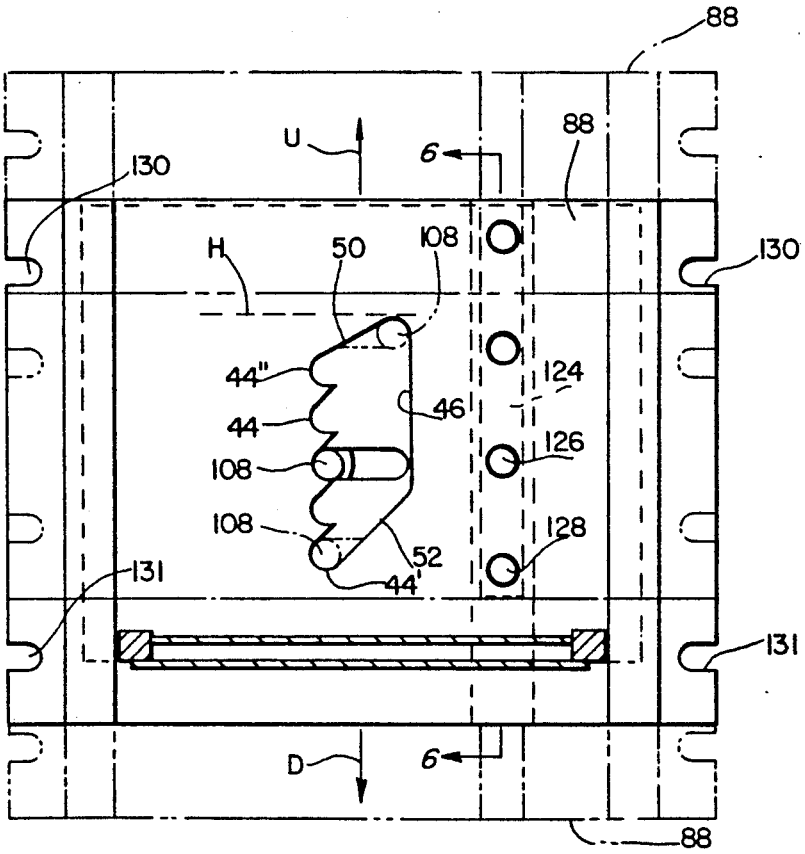
FIG. 5 is a schematic diagram to show the operation of the height adjustment mechanism of FIG. 3.
Figure 6:
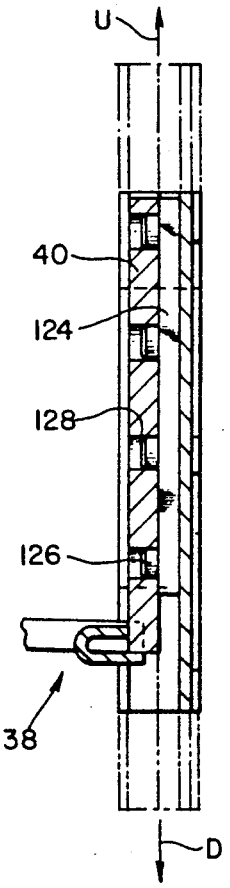
FIG. 6 is a view taken along line 6—6 of FIG. 5.

As shown in FIGS. 3, 5 and 6, the back adjustment plate 84 includes an extruded member that is generally planar having a front surface 87 and a back surface 88. With reference to its orientation in FIGS. 3 and 5, the back adjustment plate contains a centrally located slot 90 that is generally elongated in a substantially horizontal direction. Defined next to the slot, and oriented in a vertical direction, is a guide channel 92. A portion of the back surface is raised sticks out to define a strip 91 within which a portion of the guide channel is defined. The guide channel extends the full height of the adjustment plate 84. Defined on the front surface 87 near the sides of the adjustment plate are a pair of vertically oriented guide tracks 98 and 99 which together define mounting channel 86.

The back surface 88 of the adjustment plate 84 includes two outwardly projecting bosses 102 and 104 located along a vertical axis through the center of slot 90 and terminating at the top and bottom edges 91 and 93 of the surface 88.

A guide pin 106 contains a head end 108 and a back end 110. The back end includes a slot 112 within which i mounted an elongated leaf spring 114. On a preferred embodiment, the leaf spring is generally S-shaped. A small cylindrical pin 116 passes through the back end 110 and the leaf spring 114 in order to secure the leaf spring in place. Both ends of the leaf spring include a mounting hole 118. The leaf spring and guide pin are brought into contact with the back surface 88 of the adjustment plate in such a way that the head end 108 of the guide pin passes through the elongated slot 90 and emerges out of and extends away from the front surface 87 of the adjustment plate 84. At the same time, the holes 118 of the leaf spring are brought into alignment with bores 120 defined in the projections 102 and 104. Rivets 122 are used to secure the leaf spring to the projections 102 and 104.

An elongated guide bar 124 on one of its planar surfaces 125 contains a plurality of evenly spaced cylindrically-shaped bosses 126. These bosses are arranged to align with and be received by a series of vertically spaced bores 128 defined in the vertically oriented portion of the support bar. The guide bar limits the rocking motion of the chair back on the height adjustment mechanism by limiting side-to-side wobbling.

The back adjustment plate along both of its side edges contains cutouts 130 and 131 which align with bores 82 defined on the bosses 80 of the structural shell. In this way, the back adjustment plate may be mounted to the structural shell through the use of suitable fasteners, such as screws 134.

FIGS. 4, 5 and 6 illustrate the way in which vertical height adjustment of the chair back 32 is accomplished. As shown in FIG. 4, the chair back 32 is located in its bottom position relative to the seat 30. In this configuration, the pin 108 is biased into the lowest notch 44' (FIG. 5) under the urging of leaf spring 114. The leaf spring is configured in such a way that when the back adjustment pin 106 is moved in either direction away from the central vertical or transverse axis of the slot 90, the spring causes the pin to be biased in the direction that the pin has been moved toward, thus urging the pin to travel to one of the ends of slot 90.

In order to raise the chair back relative to the seat, the chair back is grasped by the user and pulled in an upward direction (arrow U). The user will then be able to perceive the movement of the pin as it is urged in the direction of the notches and registers in each of the notches as the chair back is moved in an upward direction. At the chair back's highest point, the pin 108 will be positioned in notch 44''.

In order to lower the seat back the seat back is fully raised which causes the pin 108 to be urged in the direction of the smooth surface 46. As the pin 108 rides along the upper surface 50 in the direction of smooth surface 46, the pin will pass the halfway point in slot 90 and spring 114 will urge pin 108 in the direction of surface 46. This then allows the seat back to be moved in a downward direction as the pin travels along surface 46 until the pin reaches bottom surface 52. At this point, the pin 108 will be guided in a direction toward the notches 44. Thus, when the pin 108 moves past the central axis along slot 90, the pin will be urged in a direction of notch 44' by spring 114. At this point, the height adjustment cycle may be repeated.

From the above, it is apparent that many modifications and variations of the present invention are possible in light of the above teachings. It is therefore to be understood that, within the scope of the appended claims, the invention may be practiced otherwise than as specifically described.

What is claimed is:

1. A height adjustment mechanism for controlling the height of a chair back relative to a chair seat, said height adjustment mechanism comprising:

a seat plate operatively secured to said chair seat;

a cam slot defining a closed geometric pattern of cam surfaces within said seat plate, wherein, as oriented in its position of intended use, said cam slot has two spaced vertically oriented cam surfaces, the first of said two surfaces being a smooth surface and the second of said two surfaces having a series of downwardly directed notches, and two transverse surfaces joining upper and lower ends of said two vertical surfaces, the first of said transverse surfaces angling downward relative to a horizontal axis as the first surfaces moves from said smooth surface to said notched surface and the second of said transverse surfaces angling downward relative to a horizontal axis as the second surface moves from said smooth surface to said notched surface;

a back adjustment plate operatively secured to said chair back;

slide means for aligning said seat plate and said back adjustment plate for sliding movement relative to each other;

a guide pin terminating at one end in follower means positioned within said cam slot for interacting with said surfaces of said cam slot for controlling movement of said chair back relative to said chair seat; and biasing means for movably mounting said guide pin to said back adjustment plate so that said guide pin is moved in either of two opposite directions.

2. The height adjustment mechanism of claim 1, wherein said cam slot is configured so that, in order to lower said chair back relative to said chair seat, said seat back must first be moved in a direction away from said seat so that said follower means moves to a first extreme position under the urging of said cam surface of said cam slot.

3. The height mechanism of claim 2, wherein said cam slot is configured so that, in order to raise said chair back relative to said chair seat, said seat back must be moved in a direction toward said seat so that said follower means moves to a second extreme position under the urging of said cam surfaces of said cam slot.

4. The height adjustment mechanism of claim 1, further comprising limiting means for limiting wobbling motion of said chair back as said seat plate and said back adjustment plate slide relative to each other.

5. The height adjustment mechanism of claim 4, wherein said limiting means comprises an elongated guide member selectively engageable with said seat plate and a complementary channel defined in said back adjustment plate, said channel slidably receiving said guide member.

6. The height adjustment mechanism of claim 5, wherein the longitudinal axes of said guide member and said channel are parallel to the direction of movement of said seat plate relative to said back adjustment plate.

7. An adjustable chair comprising:

a base;

a chair seat secured to said base;

a chair back;

a seat plate operatively secured to said chair seat;

a cam slot defining a closed geometric pattern of cam surfaces within said seat plate, wherein, as oriented in its position of intended use, said cam slot has two spaced vertically oriented cam surfaces, the first of said two surfaces being a smooth surface and the second of said two surfaces having a series of downwardly directed notches, and two transverse surfaces joining upper and lower ends of said two vertical surfaces, the first of said transverse surfaces angling downward relative to a horizontal axis as the first surfaces moves from said smooth surface to said notched surface and the second of said transverse surfaces angling downward relative to a horizontal axis as the second surface moves from said smooth surface to said notched surface;

a back adjustment plate operatively secured to said chair back;

slide means for aligning said seat plate and said back adjustment plate for sliding movement relative to each other;

a guide pin terminating at one end in follower means positioned within said cam for interacting with said surfaces of said cam slot for controlling movement of said chair back relative to said chair seat; and biasing means for movably mounting said guide pin to said back adjustment plate so that said guide pin is moved in either of two opposite directions.

8. The adjustable chair of claim 7, wherein said cam slot is configured so that, in order to lower said chair back relative to said chair seat, said seat back must first be moved in a direction away from said seat so that said follower means moves to a first extreme position under the urging of said cam surfaces of said cam slot.

9. The adjustable chair of claim 8, wherein said cam slot is configured so that, in order to raise said chair back relative to said chair seat, said seat back must be moved in a direction toward said seat so that said follower means moves to a second extreme position under the urging of said cam surfaces of said cam slot.

10. The adjustable chair of claim 1, further comprising limiting means for limiting wobbling motion of said chair back as said seat plate and said back adjustment plate slide relative to each other.

11. The adjustable chair of claim 10, wherein said limiting means comprises an elongated guide member selectively engageable with said seat plate and a complementary channel defined in said back adjustment plate, said channel slidably receiving said guide member.

12. The adjustable chair of claim 11, wherein the longitudinal axes of said guide member and said channel are parallel to the direction of movement of said seat plate relative to said back adjustment plate.

13. A height adjustment mechanism for controlling the height of a chair back relative to a chair seat, said height adjustment mechanism comprising:

a seat plate operatively secured to said chair seat;

a cam slot defining a closed geometric pattern of cam surfaces within said seat plate;

a back adjustment plate operatively secured to said chair back;

slide means for aligning said seat plate and said back adjustment plate for sliding movement relative to each other;

a guide pin terminating at one end in follower means positioned within said cam slot for interacting with said surfaces of said cam slot for controlling movement of said chair back relative to said chair seat;

biasing means for movably mounting said guide pin to said back adjustment plate so that said guide pin is moved in either of two opposite directions; and limiting means for limiting wobbling motion of said chair back as said seat plate and said back adjustment plate slide relative to each other, wherein said limiting means comprises an elongated guide member separate from and selectively engageable with said seat plate and a complementary channel defined in said back adjustment plate separate from said slide means, said channel slidably receiving said guide member.

14. The height adjustment mechanism of claim 13, wherein said cam slot is configured so that, in order to lower said chair back relative to said chair seat, said seat back must first be moved in a direction away from said seat so that said follower moves to a first extreme position under the urging of said cam surfaces of said cam slot.

15. The height adjustment mechanism of claim 14, wherein said cam slot is configured so that, in order to raise said chair back relative to said chair seat, said seat back must be moved in a direction toward said seat so that said follower moves to a second extreme position under the urging of said cam surfaces of said cam slot.

16. The height adjustment mechanism of claim 13, wherein the longitudinal axes of said guide member and said channel are parallel to the direction of movement of said seat plate relative to said back adjustment plate.

17. The height adjustment of claim 13, wherein, as oriented in its position of intended use, said cam slot has two spaced vertically oriented cam surfaces, the first of said two surfaces being a smooth surface and the second of said two surfaces having a series of downwardly directed notches, and two transverse surfaces joining upper and lower ends of said two vertical surfaces, the first of said transverse surfaces angles downward relative to a horizontal axis as the first surfaces moves from said smooth surface to said notched surface and the second of said transverse surfaces angles downward relative to a horizontal axis as the second surfaces moves from said smooth surface to said notched surface.

18. An adjustable chair comprising:
a base;
a chair seat secured to said base;
a chair back;
a seat plate operatively secured to said chair seat;
a cam slot defining a closed geometric pattern of cam surfaces within said seat plate;
a back adjustment plate operatively secured to said chair back;
slide means for aligning said seat plate and said back adjustment plate for sliding movement relative to each other;
a guide pin terminating at one end in follower means positioned within said cam slot for interacting with said surfaces of said cam slot for controlling movement of said chair back relative to said chair seat;
biasing means for movably mounting said guide pin to said back adjustment plate so that said guide pin is moved in either of two opposite directions; and
limiting means for limiting wobbling motion of said chair back as said seat plate and said back adjustment plate slide relative to each other, wherein said limiting means comprises an elongated guide member separate from and selectively engageable with said seat plate and a complementary channel defined in said back adjustment plate separate from said slide means, said channel slidably receiving said guide member.

19. The adjustable chair of claim 18, wherein said cam slot in configured so that, in order to lower said chair back relative to said chair seat, said seat back must first be moved in a direction away from said seat so that said follower means moves to a first extreme position under the urging of said cam surface of said cam slot.

20. The adjustable chair of claim 19, wherein said cam slot is configured so that, in order to raise said char back relative to said chair seat, said seat back must be moved in a direction toward said seat so that said follower means moves to a second extreme position under the urging of said cam surfaces of said cam slot.

21. The adjustable chair of claim 18, wherein the longitudinal axes of said guide member and said channel are parallel to the direction of movement of said seat plate relative to said back adjustment plate.

22. The adjustable chair of claim 18, wherein, as oriented in its position of intended use, said cam slot has two spaced vertically oriented cam surfaces, the first of said two surfaces being a smooth surface and the second of said two surfaces having a series of downwardly directed notches, and two transverse surfaces joining upper and lower ends of said two vertical surfaces, the first of said transverse surfaces angles downward relative to a horizontal axis as the first surfaces moves from said smooth surface to said notched surface and the second of said transverse surface angles downward relative to a horizontal axis as the second surface moves from said smooth surface to said notched surface.

23. A height adjustment mechanism for controlling the height of a chair back relative to a chair seat, said height adjustment mechanism comprising:
a seat plate operatively secured to said chair seat;
a cam slot defining a closed geometric pattern of cam surfaces within said seat plate, wherein, as oriented in its position to intended use, said cam slot has two spaced vertically oriented cam surfaces and upper and lower transverse surfaces joining upper and lower ends of said two vertical surfaces, said upper transverse surface angling downward relative to a horizontal axis as said upper transverse surface moves from the first to the second of said vertically oriented cam surfaces and said lower transverse surface angling downward relative to a horizontal axis as said lower transverse surface moves from the first to the second of said vertically oriented cam surfaces;
a back adjustment plate operatively secured to said chair back;
slide means for aligning said seat plate and said back adjustment plate for sliding movement relative to each other;
a guide pin terminating at one end in follower means positioned within said cam slot for interacting with said cam surfaces of said cam slot for controlling movement of said chair back relative to said chair seat;
guide means for limiting motion of said guide pin to a substantially horizontal direction, said guide means having a central vertical axis and a pair of side surfaces, one on either side of said central vertical axis; and
biasing means for movably mounting said guide pin to said back adjustment plate and for biasing said guide pin in a horizontal plane towards one of said side surfaces of said guide means when said guide pin moves from the other of said said surfaces past said central vertical axis of said guide means, whereby said guide pin is biased to move up said upper transverse surface from said second to said first of said vertically oriented cam surfaces when said guide pin reaches the upper end of said second vertically oriented cam surface, and whereby said guide pin is biased to move down said lower transverse surface from said first to said second of said vertically oriented cam surfaces when said guide pin reaches the lower end of said first vertically oriented cam surface.

24. The height adjustment mechanism of claim 23, wherein said cam slot is configured so that, in order to lower said chair back relative to said chair seat, said seat back must first be moved in a direction away from said seat so that said follower means moves to a first extreme position under the urging of said cam surfaces of said cam slot.

25. The height adjustment mechanism of claim 24, wherein said cam slot is configured so that, in order to raise said chair back relative to said chair seat, said seat back must be moved in a direction toward said seat so that said follower moves to a second extreme position under the urging of said cam surfaces of said cam slot.

26. The height adjustment mechanism of claim 23, further comprising limiting means for limiting wobbling motion of said chair back as said seat plate and said back adjustment plate side relative to each other.

27. The height adjustment mechanism of claim 26, wherein said limiting means comprises an elongated guide member selectively engageable with said seat plate and a complementary channel defined in said back adjustment plate, said channel slidably receiving said guide member.

28. The height adjustment mechanism of claim 27, wherein the longitudinal axes of said guide member and said channel are parallel to the direction of movement of said seat plate relative to said back adjustment plate.

29. The height adjustment mechanism of claim 23, wherein said guide means comprises a guide slot within said back adjustment plate, and wherein an oriented in its position of intended use, said guide slot is elongated in a substantially horizontal direction.

30. The height adjustment mechanism of claim 23, wherein said first vertically oriented cam surface is substantially smooth and said second vertically oriented cam surface has a series of downwardly directed notches.

31. An adjustable chair comprising:

a base;

a chair seat secured to said base;

a chair back;

a seat plate operatively secured to said chair seat;

a cam slot defining a closed geometric pattern of cam surfaces within said seat plate, wherein, as oriented in its position of intended use, said cam slot has a central vertical axis, two spaced vertically oriented cam surfaces one either side of said central vertical axis, and two transverse surfaces joining upper and lower ends of said two vertical surfaces, the first of said transverse surfaces angling downward relative to a horizontal axis as the first surfaces moves from said smooth surface to said notched surface and the second of said transverse surfaces angling downward relative to a horizontal axis as the second surface moves from said smooth surface to said notched surface;

a back adjustment plate operatively secured to said chair back;

slide means for aligning said seat plate and said back adjustment plate for sliding movement relative to each other;

a guide pin terminating at one end in follower means positioned within said cam slot for interacting with said cam surfaces of said cam slot for controlling movement of said chair back relative to said chair seat;

guide means for limiting motion of said guide pin to a substantially horizontal direction, said guide means having a central vertical axis and a pair of side surfaces, one on either side of said central vertical axis; and biasing means for movably mounting said guide pin to said back adjustment plate and for biasing said guide pin in a horizontal plate towards one of said side surfaces of said guide means when said guide pin moves from the other of said side surfaces past and central vertical axis of said guide means, whereby said guide pin is biased to move up said upper transverse surface from said second to said first of said vertically oriented cam surfaces when said guide pin reaches the upper end of said second vertically oriented cam surface, and whereby said guide pin is biased to move down said lower transverse surface from said first to said second of said vertically oriented cam surfaces when said guide pin reaches the lower end of said first vertically oriented cam surface.

32. The adjustable chair of claim 31, wherein said cam slot is configured so that, in order to lower said chair back relative to said chair seat, said seat back must first be moved in a direction away from said seat so that said follower means moves to a first extreme position under the urging of said cam surfaces of said cam slot.

33. The adjustable chair of claim 32, wherein said cam slot is configured so that, in order to raise said chair back relative to said chair seat, said seat back must be moved in a direction toward said seat so that said follower moves to a second extreme position under the urging of said cam surfaces of said cam slot.

34. The adjustable chair of claim 31, further comprising limiting means for limiting wobbling motion of said chair back as said seat plate and said back adjustment plate slide relative to each other.

35. The adjustable of claim 34, wherein said limiting means comprises an elongated guide member selectively engageable with said seat plate and a complementary channel defined in said back adjustable plate, said channel slidably receiving said guide member.

36. The adjustable chair of claim 35, wherein the longitudinal axes of said guide member and said channel are parallel to the direction of movement of said seat plate relative to said back adjustment plate.

37. The adjustable chair of claim 31, wherein said guide means comprises a guide slot within said back adjustment plate, and wherein as oriented in its position of intended use, said guide slot is elongated in a substantially horizontally direction.

38. The adjustable chair of claim 31, wherein said first vertically oriented cam surface is substantially smooth and said second vertically oriented cam surface has a series of downwardly directed notches.

* * * * *